United States Patent [19]

Fattibene

[11] Patent Number: 4,735,437

[45] Date of Patent: Apr. 5, 1988

[54] QUICK TEAR TRACTOR FEED COMPUTER PAPER

[76] Inventor: Paul A. Fattibene, 2480 Post Rd., Southport, Conn. 06490

[21] Appl. No.: 883,534

[22] Filed: Jul. 9, 1986

[51] Int. Cl.[4] ..... B42D 5/00; B42D 19/00

[52] U.S. Cl. ..... 281/2; 281/5

[58] Field of Search ..... 281/2, 5, 7, 8, 10, 281/11, 12, 14, 50; 282/3 R, 3 B, 5, 7, 9 R, 11, 5 A, 15 R, 15 A, 16 B, 166

[56] References Cited

U.S. PATENT DOCUMENTS

| | | | |
|---|---|---|---|
| 405,412 | 6/1889 | Hicks | 281/5 |
| 2,011,572 | 8/1935 | Eiseman | 281/5 |
| 2,532,664 | 12/1950 | Freedman | 281/5 |
| 2,620,205 | 12/1952 | Vogt | 281/5 |
| 2,696,991 | 12/1954 | Rieger | 281/5 |
| 4,508,365 | 4/1985 | Hawes | 281/2 |

*Primary Examiner*—Frank T. Yost

*Assistant Examiner*—Paul M. Heyrana, Sr.

*Attorney, Agent, or Firm*—Arthur T. Fattibene; Paul A. Fattibene

[57] ABSTRACT

A continuous ream or web of computer paper having detachable longitudinal marginal strips with tractor feed holes, and having adjacent pair of detachable lateral strips longitudinally spaced along the web for separating the continuous web of paper into a plurality of sheets. A fold of reduced folding resistance for encouraging folding of the web thereat in disposed between the pair of detachable lateral strips to facilitate fan-folding of the web along a fold line disposed between the adjacent pairs of lateral strips rather than at the detachable portion of the lateral strips. The longitudinal and lateral marginal strips are formed so that they can be readily removed while the continuous web of paper is fan-folded to form a stack separated and individual sheets of paper.

1 Claim, 3 Drawing Sheets

QUICK TEAR TRACTOR FEED COMPUTER PAPER

FIELD OF THE INVENTION

This invention relates generally to continuous tractor feed computer paper and more specifically to tractor feed computer paper having marginal portions capable of being readily spearated to form individual, disconnected sheets of paper.

BACKGROUND OF THE INVENTION

With the increasing use of computers and hard copy printouts the need arises to provide a means to generate printouts in a form that resembles a standard single sheet of paper. Existing continuous tractor feed computer paper contains a strip on either side of the longitudinal edge of the paper to provide guide holes for the tractor feed. The bottom and top of the paper sheet are physically attached to a next adjacent sheet, forming a continuous ream or web of paper so that multiple pages can be printed without having to manually feed the printer with successive individual sheets of paper. After a plurality of th connected sheets of paper have been printed, the sheets are normally fan-folded into a stack. The strip on either side of the edge of the paper containing the guide holes for the tractor feed can be removed while the paper is fan-folded in a stack without unfolding each individual sheet of paper. However, to separate the continuous sheet or web of paper to form individual sheets, the fan-folded continuous sheet must be unfolded, and each portion between the folds being individually separated. Such procedure is a time consuming and tedious process.

OBJECTS

It is an object of this invention to provide continuous web of tractor fed computer paper, which when fan-folded is provided with tear lines about all edges whereby the marginal portion can be readily separated to form individual sheets.

It is a further object of this invention to provide a continuous web of tractor feed computer paper which is adapted to be fan-folded and capable of being separated into individual sheets quickly and easily.

It is yet another object of this invention to provide continuous tractor feed computer paper capable of being easily folded or creased along a line extending transversely between two parallel lines of perforation or easy tear lines.

It is another object of this invention to provide a continuous web of tractor feed computer paper having the sheet portions thereof capable of being torn from the ream or web of paper easily without removing the ream of paper from the printer and without ripping or bending other continuous sheets of paper.

It is a feature of this invention to have spaced apart hole segments adjacent the transverse fold lines about which the continuous web or ream of paper fan-folds.

SUMMARY OF THE INVENTION

The foregoing objects and other features and advantages are attained by a continuous sheet or web of paper stock having opposed longitudinally extending marginal portions defined by a pair of longitudinally extending frangible or readily tear lines. The respective longitudinal marginal portions are provided with a series of guide holes for engaging the tractor feed that feeds the continuous sheet or web to a printer. The continuous web is also provided with a series of transversely extending foldlines about which the web can be fan-folded to define a stack of connected folded sheets. Disposed on opposite sides of the transverse fold lines are transverse marginal portions which are defined by a transverse frangible line or tear line. The arrangement is such that in the fan-folded position the respective longitudinal and transverse marginal portions are superimposed so that they can be readily separated from the main portion of the stacked fan-folded web to define a stack of individual sheets.

To facilitate the fan-folding of the continuous web, the transverse marginal portions between adjacent sheets may be provided with a series of holes which extend to opposite sides of the transverse fold line.

FEATURES

A feature of this invention resides in the provision wherein the continuous web is provided with frangible tear lines that extend longitudinally of the web, and transversely thereof at spaced intervals longitudinally of the web so that in a fan-folded position, the longitudinal and transverse marginal portions are superimposed and can be readily separated therefrom to define a stack of individual sheets.

Anothere feature resides in the provision of a series of holes formed along the respective transversely extending fold lines to facilitate the fan-folding of the continuous strip or web.

Another feature resides in the provision whereby the holes extending along the transverse fold lines are disposed within the adjacent transverse marginal portion disposed to either side of the transverse fold line.

Other features and advantages will become more readily apparent when considered in view of the drawings and detail description in which.

DETAILED DESCRIPTION

Figure 1:
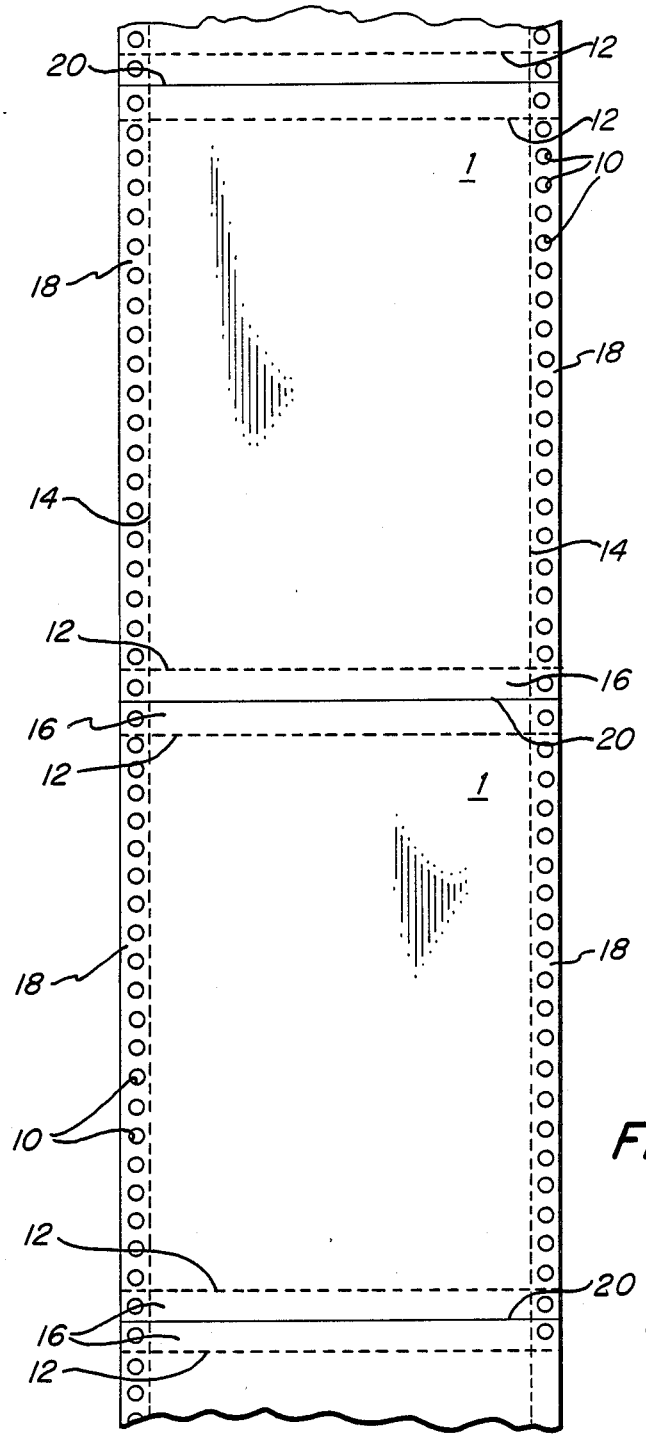
FIG. 1 is a front elevational view of a continuous unfolded web or sheet of paper embodying the present invention.

FIG. 1 shows a continuous web of paper defining a series of sheets to form a continuous ream which is adapted to be fan-folded about transverse fold lines 20. Along the longitudinal edges of the respective sheets of paper are longitudinal marginal position 18. The longitudinal strips or marginal portion 18 are attached to the edges of the main position or sheet 1 by longitudinal perforations or slits 14 to define a frangible tear line. The longitudinal perforations 14 are of such a nature so that when the longitudinal marginal strips 18 are removed, the edges of the paper sheets 1 are relatively smooth giving the appearance of a standard individual paper shets. The longitudinal margin or strip 18 contain tractor feed holes 10 so that the continuous sheets of paper can feed into a conventional printer tractor feed system popular on most computer printers.

The continuous web of paper can be fan-folded along transverse fold lines 20 or creases 20. The fold lines or creases 20 can be formed by any method of folding paper including scribing or perforating the fold or crease 20. Disposed on either side of fold 20 and slightly spaced therefrom are lateral or transverse perforations 12 to define a frangible tear line. Between the lateral perforations 12 and fold 20 there is formed a lateral or transverse marginal portion 16. The lateral perforations 12 should be of the same type as longitudinal perforations 14 so that when the marginal portion 16 and 18 are removed, the longitudinal and transverse edges of the paper are relatively smooth giving the appearance of a standard die cut, individual sheet of paper.

When the described web or continuous strip of connected sheets are fan-folded in a stack after printing, longitudinal marginal strips 18 and lateral or transverse strips 16 can be readily removed due to the defined frangible tear lines, creating a stack of individual sheets of paper 1.

Figure 2:
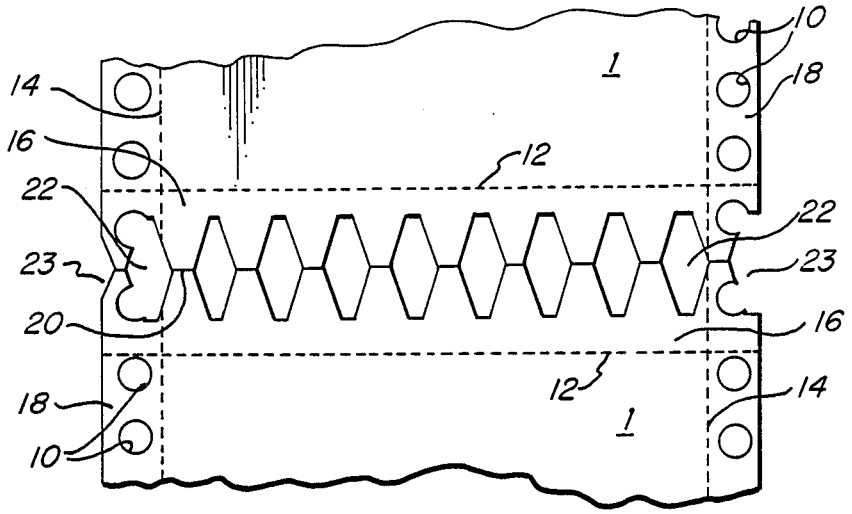
FIG. 2 is a fragmentary portion of an unfolded ream or sheet of paper showing another embodiment of the invention.

FIG. 2 shows another embodiment of the present invention. This embodiment is similar to that described, except that a series of holes 22 are formed in lateral strip position 16. The holes 22 facilitate or insure that the continuous ream of connected sheets of paper 1 fold along the fold lines or creases 20 rather than on lateral perforations 12. In this embodiment the holes are generally diamond shape with the widest portion located on the fold or crease 20. As shown the holes 22 extend to either side of the fold line or crease 20, and into the adjacent marginal position 16. This reduces the resistance of the fold or crease 20 to bend, thereby aiding the continuous ream of connected sheets to fold along the fold or crease 20 in forming a fan-fold stack. The holes 22 may be of any shape, but preferably should be of a shape having its widest dimension or diameter coincident with fold or crease 20. This provides the lease amount of folding resistance to occur at the fold or crease 20 when the continuous web of paper is fan-folded and stacked. Holes-22 thus prevents the fold from occurring at the lateral perforations 12 where the continuous ream of sheets of paper 1 might have a tendency to fold, if not for the holes 22. The holes 22 also aid in separating portions of the continuous web of paper 1 from a printer without removing the continuous web 1 from the tractor feed holes 22 define a tear line at the fold line 20. The fan-folded paper can easily be torn along the crease or fold 20 because of holes 22 without disturbing the lateral perforations 12. This is made especially easy because of the endmost hole segment or portions 23 adjacent the opposed longitudinal edge of the continuous ream of sheets of paper 1. Hole segment 23 permits or facilitates the start of the tear along fold or crease 20. This assures that the portion of the continuous web or paper can be removed easily without tearing or bending of the sheet of paper 1, except along the fold line 20.

Figure 3:
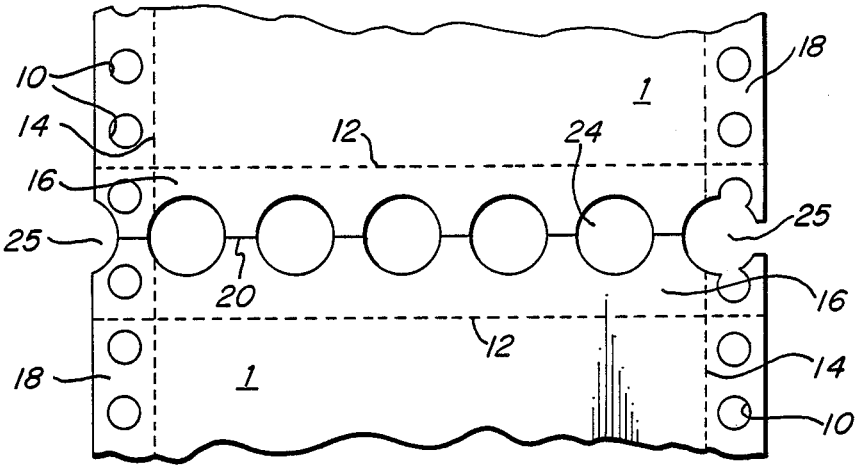
FIG. 3 is a portion of an unfolded ream or sheet of paper showing yet another embodiment of the invention.

FIG. 3 shows another embodiment of the present invention. The embodiment shows circular holes 24 formed in transverse or lateral marginal strips 16 to assist the sheets portions 1 to fan fold along fold or crease 20. The endmost circular hole segments or portions 25 also help the continuous ream of sheets of paper 1 to tear along the fold or crease 20 as did the hole segments or portions 23 in FIG. 2, when separating a portion of the continuous web from itself along fold lines 20.

Figure 4:
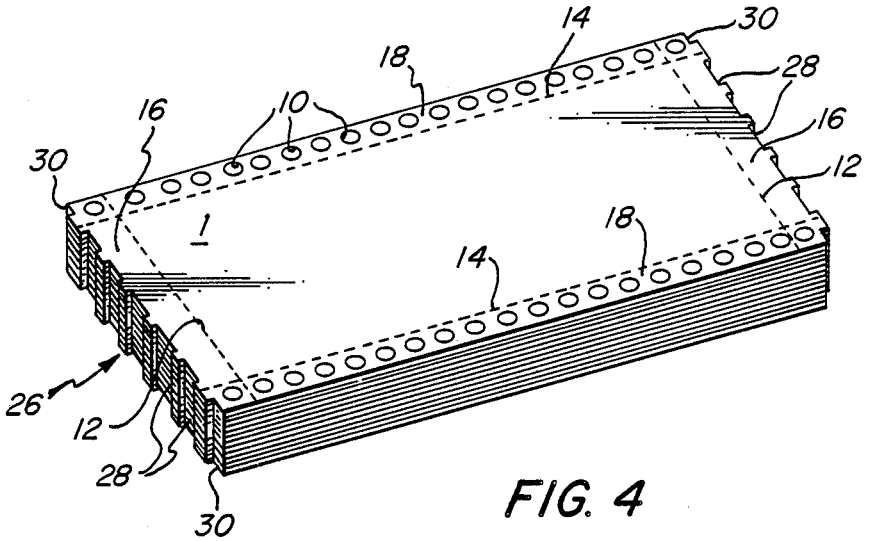
FIG. 4 is a perspetive view of a fan-folded ream of paper showing another embodiment of the invention.

FIG. 4 shows a continuous web 26 in a fan-folded stack of connected paper sheets. Longitudinal marginal strips 18 contain tractor feed holes 10. Lateral or transverse marginal strips 16 have rectangular holes 28 which assist folding. The longitudinal strips 18 are removed along longitudinal perforations 14 in a group without unfolding the continuous ream of paper sheets 1. Likewise, lateral strips 16 can be removed along lateral perforations 12 without unfolding the continuous fan-folded web of paper sheets 1. After removal of marginal strips 16 and 18, the individual sheets of paper are stacked and unattached to be sorted quickly.

The dimensions of the strips 16 and 18 are designed so that after removal, a finished sheet of paper can be obtained, for example a standard 8 1/2 by 11 inch letter sheet; or the margins can be proportion to define a legal size sheet, or any other desired size.

The computer printer can also have a configuration to provide the appropriate page breaks for printing on a standard 8 1/2 by 11 inch portion of the ream or web of paper; or other disired size.

While the invention has been described with respect to several embodiments, it will be understood and appreciated that variation and modification may be made without departing from the scope or spirit of the invention.

What is claimed is:

1. A continuous web of tractor feed paper comprising a continuous, elongated web of paper having opposed longitudinal edges, a frangible tear line spaced inwardly from each of said longitudinal edges to define an opposed longitudinally extending marginal strip, each of said strips having a plurality of tractor feed holes longitudinally spaced therein, whereby said strips are rendered detachable from said web along said frangible tear line, a plurality of spaced apart pairs of laterally extending frangible tear means extending transversely of said web at longitudinally spaced intervals therealong to define a series of connected sheets, a frangible folding and tear means disposed between each of said pair of said laterally extending frangible tear means about which said web may be fan-folded, said frangible folding and tear means including a crease line extending laterally between each pair of said spaced apart frangible tear means, and a series of spaced holes formed between each pair of said spaced apart frangible tear means whereby said holes have a portion thereof disposed to either side of said crease line whereby the fold and tear resistance along said crease line is less than fold and tear resistance of said spaced apart frangible tear means.

* * * * *